US006206214B1

(12) United States Patent
de Koning et al.

(10) Patent No.: US 6,206,214 B1
(45) Date of Patent: Mar. 27, 2001

(54) NON-METALLIC COUPLER CARRIER WEAR PLATE FOR A RAILCAR

(75) Inventors: Todd J. de Koning, Tinley Park, IL (US); R. Michael Manley, Richmond, TX (US)

(73) Assignee: Holland Company, Crete, IL (US)

( * ) Notice: Subject to any disclaimer, the term of this patent is extended or adjusted under 35 U.S.C. 154(b) by 0 days.

(21) Appl. No.: 09/137,160

(22) Filed: Aug. 20, 1998

Related U.S. Application Data

(60) Provisional application No. 60/063,807, filed on Oct. 31, 1997.

(51) Int. Cl.[7] ..... B61G 1/00

(52) U.S. Cl. ..... 213/61; 213/21; 213/50; 213/60; 213/61; 213/62 R

(58) Field of Search ..... 213/50, 60, 61, 213/62 R, 78

(56) References Cited

U.S. PATENT DOCUMENTS

| | | | | |
|---|---|---|---|---|
| 1,432,536 | * | 10/1922 | Cook | 213/61 |
| 4,032,017 | * | 6/1977 | Larsen | 213/61 |
| 4,042,117 | * | 8/1977 | McClurg | 213/50.5 |
| 4,055,254 | | 10/1977 | Chienici et al. | 213/61 |
| 4,059,192 | | 11/1977 | Larsen | 213/61 |
| 4,133,434 | | 1/1979 | Chienici | 213/61 |
| 4,343,407 | | 8/1982 | Murphy | 213/51 |
| 4,344,541 | | 8/1982 | Chienici | 213/61 |
| 4,345,689 | | 8/1982 | Chienici | 213/61 |
| 4,674,639 | | 6/1987 | Kaim | 213/61 |
| 4,706,826 | | 11/1987 | Elliott et al. | 213/61 |
| 5,174,457 | | 12/1992 | Carroll et al. | 213/61 |

* cited by examiner

*Primary Examiner*—S. Joseph Morano
*Assistant Examiner*—Frantz Jules
(74) *Attorney, Agent, or Firm*—Lee, Mann, Smith, McWilliams, Sweeney & Ohlson

(57) ABSTRACT

A railcar coupler carrier wear plate is formed in an "L" shaped section for ease of insertion and replacement in a coupler carrier and for efficient manufacture, the coupler carrier wear plate being retained in the coupler carrier with a bracket arrangement that can be readily affixed to the coupler carrier as by welding and which can also be adapted to protect the coupler carrier wear plate in the event of a coupler override.

16 Claims, 3 Drawing Sheets

NON-METALLIC COUPLER CARRIER WEAR PLATE FOR A RAILCAR

This patent application claims priority based on the provisional patent application filed Oct. 31, 1997 as Ser. No. 60/063,807.

BACKGROUND OF THE INVENTION

Railcar coupler carrier wear plates are a standard in the rail transportation field. Typical coupler wear plates have been designed in configurations to match coupler carriers developed decades before.

Typically, the coupler carrier wear plate is a fairly labor intensive item to replace typically designed with both inner and outer flanges and requiring removal of the coupler for replacement. While this operation is far less capital intensive than replacing a coupler, labor costs, as well as cost for parts and materials, are a significant factor. Further, cost of manufacturing the wear plate is a consideration and different configurations can have improved economy if effectively adaptable for use in the field. Finally, adaptability of a particular coupler carrier wear plate form to a maximum number of different coupler carrier and striker configurations has additional advantages and economy.

The above described coupler carrier wear plate is mounted to the rail car's coupler carrier using preferably metal retaining brackets. These brackets have the primary purpose of retaining the wear plate in position, but have an additional advantage in that they provide protection for the plastic wear plate in the event of a coupler bypass—that is when misaligned couplers of railcars do not couple and one coupler strikes the opposite car.

The configuration of this invention has an advantage in manufacturing over typical "T" shaped wear plates, such as that in U.S. Pat. No. 4,327,839 in that the additional flanges having runs longitudinal (relative to the car) cannot easily be extruded. The brackets and configuration enable ease of manufacture, while positioning the coupler carrier wear plate more securely than either "T" style or channel style wear plates, a channel style wear plate being disclosed in U.S. Pat. No. 4,055,254, commonly owned with this application. The disclosures in U.S. Pat. Nos. 4,055,254 and 4,327,839 are incorporated by reference in this application.

BRIEF DESCRIPTION OF THE DRAWINGS

The following drawings, in which like reference characters indicate like parts, are illustrative of embodiments of the invention and are not intended to limit the scope of the invention in any manner whatsoever, as encompassed by the claims forming a part hereof.

DETAILED DESCRIPTION OF THE PREFERRED EMBODIMENT

Figure 1:
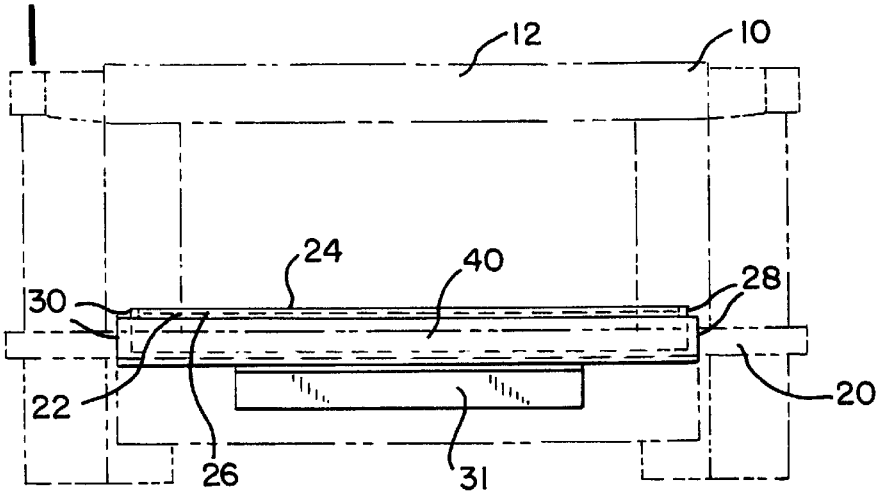
FIG. 1 is a front elevation of a coupler carrier wear plate installed in a striker casting.

A draft gear assembly 10 for a railcar has striker 12 mounted in the conventional manner to the railcar coupler carrier 20. In this particular instance coupler carrier 20 is of a bell mouth configuration having walls 16, 18 diverging upwardly so as to provide improved clearance for the customary coupler and shank arrangement as will be familiar to one of ordinary skill in the art. The clearance provided for wall 16, 18 is one advantage of the invention. Coupler carrier 20 provides a structural support for the coupler. Coupler carrier 20 is a standard component which a person of ordinary skill will understand varies particularly as to depth and configuration from manufacturer to manufacturer. Prior art coupler carrier wear plates have, therefore, been adapted to particular depth coupler carriers. A prior art coupler carrier wear plate with flanges too closely spaced together would not fit on the more deep coupler carriers, while in the prior art coupler carrier wear plates with flanges spaced too far apart unwanted movement will be present in the wear plate as the coupler bears on the wear plate. The invention has a coupler carrier wear plate 22 having a substantially "L" shaped configuration denoted by a relatively deep bearing flange 24 and a downwardly depending outer flange 26 of fairly narrow section.

Figure 2:
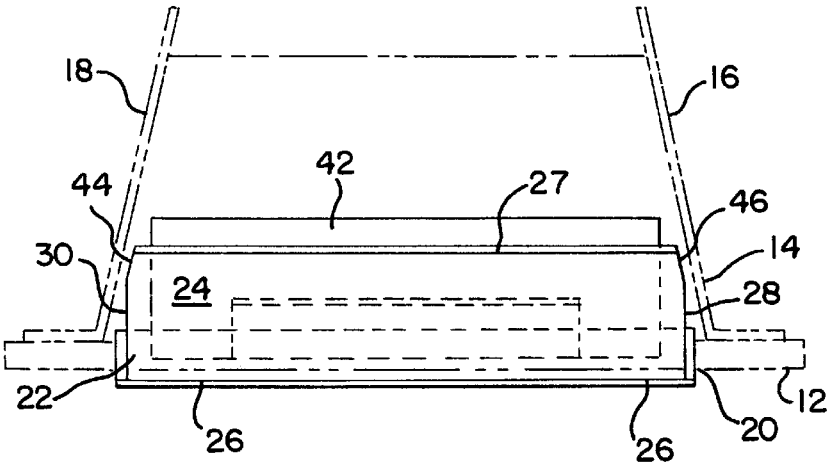
FIG. 2 is a top sectional view of a railcar coupler carrier with the coupler carrier wear plate in place.
Figure 3:
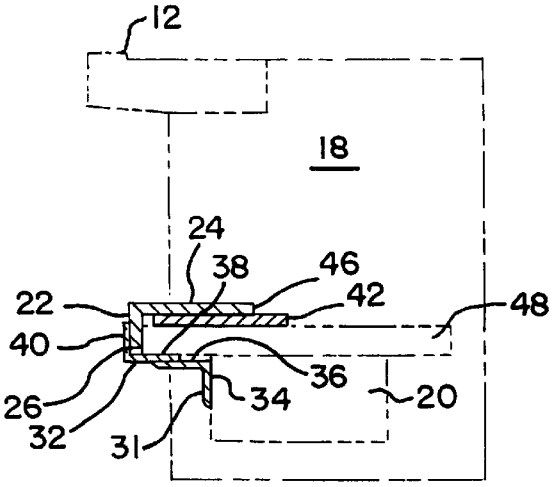
FIG. 3 is a left side sectional view of a railcar coupler carrier with the coupler carrier wear plate in place.

For ease of insertion and replacement, the coupler carrier wear plate 22 is therefore formed with flange 24 terminating in interior edge 27 as shown in FIG. 2 and FIG. 3 such that a generally "L" shape is present. At a thickness for flange 24, of about one-half inch (½"), formed, as taught, into a substantially flat bearing flange form, only a slight raising of the coupler by a jack is needed to remove or insert a wear plate 22. Flanges 24, 26 have side end surfaces 28, 30 being continuous at the sides of both flanges 24, 26.

The person of ordinary skill will be familiar with the strict standards for the various clearances in railcar draft gear components. Permissible movement of the coupler within the draft assembly 10, and more particularly relative to the coupler carrier 20, is such that insertion of flange 24 enabled by the aforementioned jacking of the coupler. By comparison, a prior art channel shaped coupler carrier wear plate has an internal flange of generally the same vertical extent as outer flange 26 which accordingly requires removal of the coupler to insert or replace a coupler carrier wear plate.

Coupler carrier wear plate 22 is maintained in place on coupler carrier 20, in the preferred embodiment, through the use of bottom bracket 31 which supports top bracket 32. Brackets 31, 32 are formed of standard steel angles. Bottom bracket or angle 31 has a first flange 34 which is affixed to carrier 20 by welding or other suitable mode of affixation. Bottom bracket 31 also has second flange 36 which supports top bracket or angle 32 at flange 38. Top bracket or angle 32 has flange 40 normal to flange 38. Coupler carrier wear plate is retained by the capturing of flange 26 between flange 40 and coupler carrier 20.

For proper alignment of bearing flange 24 vertically, shim 42 can be placed on coupler carrier 20 as described below. Flange 40 can be manually compressed with a hammer or like device to compress wear plate flange 26 between bracket flange 40 and coupler carrier 20.

An advantage in the current configuration of coupler carrier wear plate 22 is that sides 28 and 30 can be sized to fit a maximum dimension within walls 16, 18. Further, beveled side edges 44, 46 provides a maximum width as well as a maximum depth while conforming to the coupler carrier configuration. Another advantage is that the brackets use to retain the coupler carrier wear plate provide protection for the plastic wear plate in the event of a coupler bypass.

The determination of whether or not to install shim 42 and the installation procedures generally will be dependent upon the clearances and dimensions necessary to bring the coupler height within AAR specifications. If wear plate 22 having a thickness of flange 24 of about one-half inch (½") provides adequate coupler height itself or adequate coupler height with existing shims, there is no need, upon initial installation, to even remove the coupler. In the event shim 42 is needed for coupler height within specifications, on initial installation, the coupler will need to be removed, however, for subsequent renewal of a worn wear plate 22, coupler removal will not be necessary.

Initial installation will thence proceed by inserting wear plate 22 against coupler carrier top plate 48 such that flange 26 abuts the outer portion of top plate 48. Sides 28, 30 and beveled edges 44, 46 should be centered within coupler carrier walls 16, 18. Top bracket 32 is then centered against flange 26 of the wear plate 22. Bracket 32 is then raised to contact the bottom of carrier top plate 48, or alternatively, to within one-half inch (½") of the top surface of flange 24 at its intersection with the outer surface of flange 26.

Once the top bracket 32 is in place, bottom bracket 31 will be placed back against the carrier structure under top plate 48 and contacted against top bracket 32, specifically flanges 36, 38 contacting one another. In this position, the bottom bracket 31 will be welded to coupler carrier 20. With the top bracket firmly against flange 26, it will then be welded to bottom bracket 31 along the joint therebetween.

The coupler, if removed, can be repositioned, or the jack released if the coupler was merely jacked up to provide clearance where adding shim 42 was unnecessary. With the load of the coupler bearing on wear plate 22's flange 24, bracket flange 40 can then, if necessary, be deformed to insure an interference fit as by use of a hammer, appropriate clamp, jack, or other suitable means.

Alternative embodiments are provided addressing the bracket arrangement; a clip arrangement; and different flange configurations for appropriate railcar coupler carriers. Various modifications can be made consistent with the teachings of this invention in the using of metal brackets or clips to retain a generally "L" shaped coupler carrier wear plate doing away with the prior art channeled shaped coupler carrier wear plate.

Figure 6:
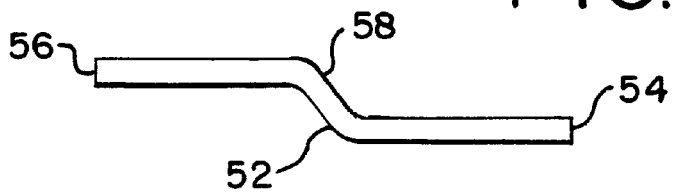
FIG. 6 is a top plan view of a clip for the alternative mounting of the coupler carrier wear plate.
Figure 5:
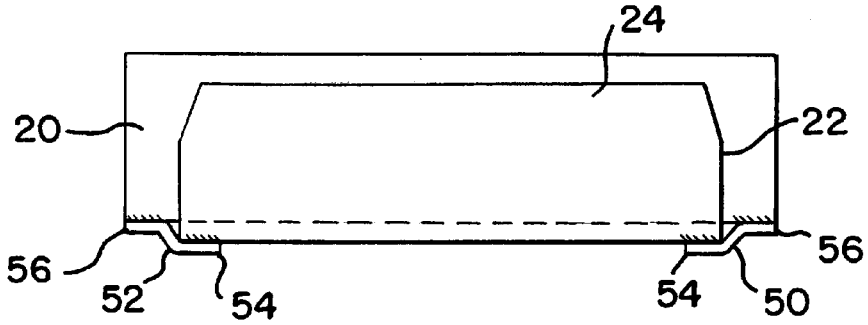
FIG. 5 is a top plan view of the alternative mounting for the coupler carrier wear plate.
Figure 4:
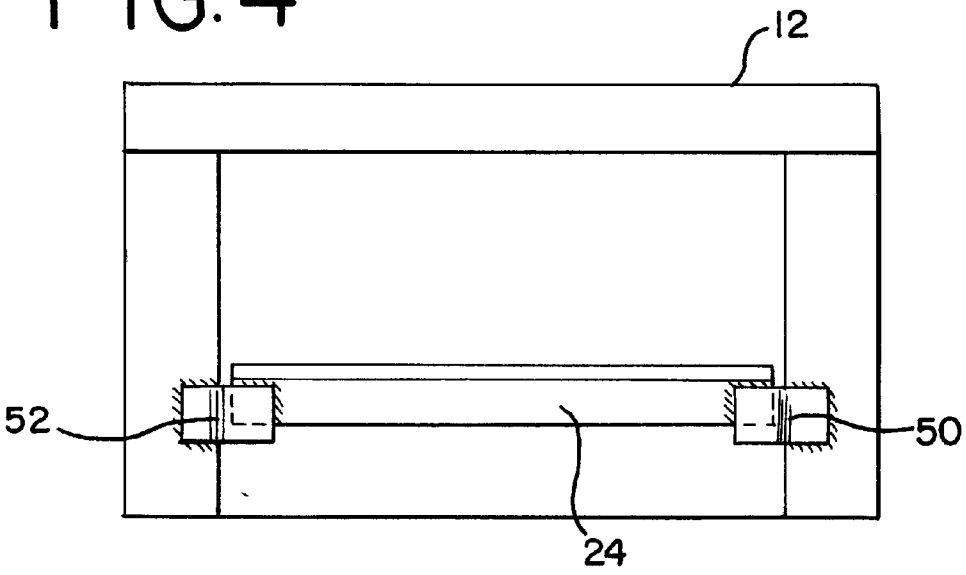
FIG. 4 is a front elevational view of an alternative embodiment for mounting the coupler carrier wear plate.
Figure 7:
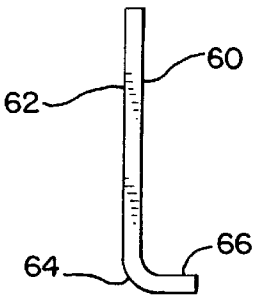
FIG. 7 is a left side elevation of an alternative configuration for a coupler carrier wear plate.
Figure 9:
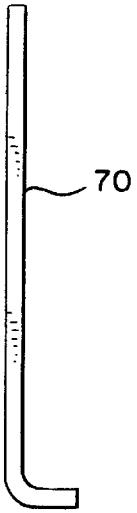
FIG. 9 is a left side elevation of an alternative configuration for a coupler carrier wear plate.
Figure 8:
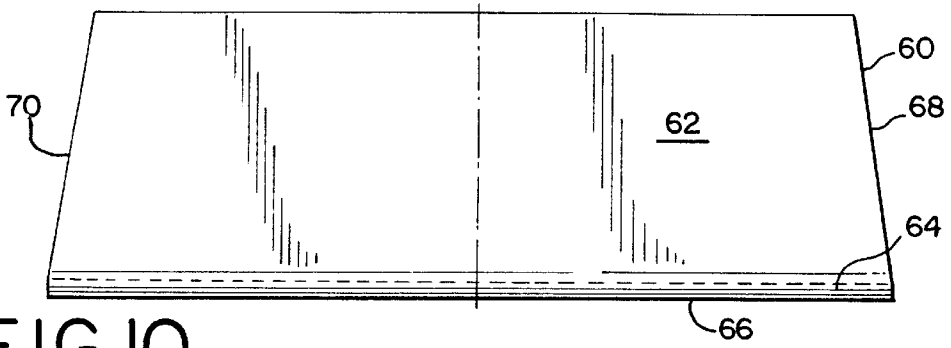
FIG. 8 is a top plan view of the alternative embodiment of the coupler carrier wear plate.
Figure 10:
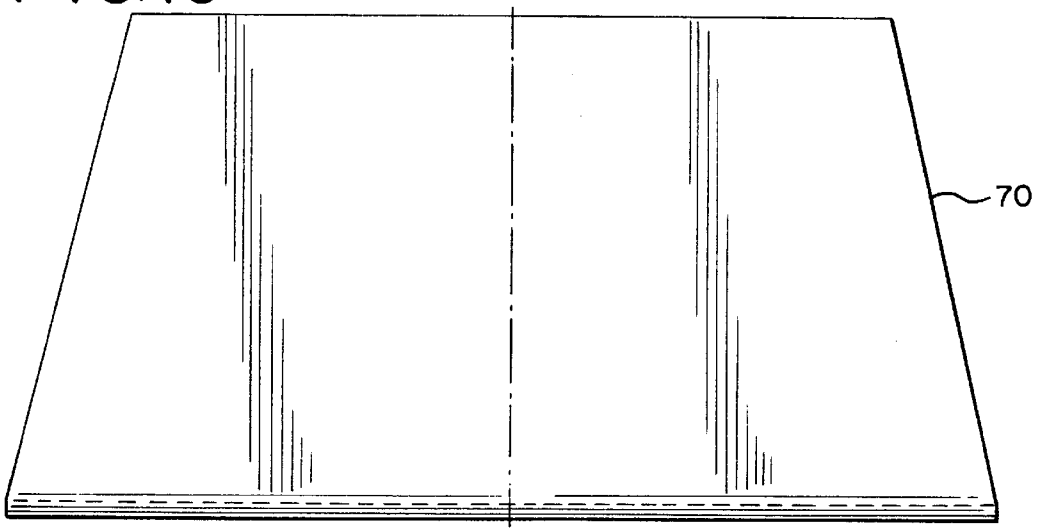
FIG. 10 is a top plan view of the alternative embodiment of the coupler carrier wear plate.

An alternative embodiment is shown in FIGS. 4, 5, and 6, which eliminates brackets 31, 32 substituting therefor clips 50, 52. Clips 50, 52 are formed in a generally "Z" shaped section and are symmetric such that one is the mirror image of the other. By inverting the stamped cast, or otherwise formed, clip it will fit the opposite side of the wear plate 22.

It will be seen that clip 50, 52 is formed to have opposed flanges 54, 56 at opposite ends, said flanges being joined by a narrow web 58 which imparts a displacement of the axes of flanges 54, 56 sufficient to capture coupler carrier wear plate 22's flange 24 against coupler carrier 20. As is seen in FIG. 5, flange 56 can be welded to coupler carrier 20 and, depending on the design of carrier 20, potentially directly to top plate 48, if present. If clearances permit, it may also be welded directly to striker 12, as the specific installation requires. Clip 50 corresponds to clip 52 except that it has been inverted. Flange 56 of clip 50 is welded as previously described with respect to clip 52.

FIGS. 7, 8, 9, and 10 show alternative configurations for the coupler carrier wear plate itself. It will be seen that these alternatives remain generally "L" shaped, however, the intersection between the respective bearing flanges and downwardly depending flanges has been formed into a smooth radius rather than a ninety degree (90°) intersection of flanges 22, 24. Also notable is the change in plan shape of the respective bearing flanges.

It will be seen that wear plate 60 has bearing flange 62 with a radius portion 64 merging into downwardly depending flange 66. Sides 68, 70 smoothly taper inwardly from flange 66 and radius portion 64. This configuration can be designed to maximize the width of specific bell mouth coupler carriers showing a taper from about twenty-two and one-quarter inch (22¼") to a width of twenty inches (20") in a depth of about eight inches (8"). These dimensions are merely illustrative of proportions that will fit particular bell mouth coupler carriers in the field. However, the configuration could be adapted to different sizes for different coupler carriers, and is therefor of more universal application. Similarly, wear plates 60, in FIG. 9 and FIG. 10 have a similar configuration but a greater width and depth tapering from about twenty-six inches (26") at the flange 86 to twenty inches (20") at the interior edge 87 in a depth of about fourteen and one-quarter inches (14¼"). These illustrative dimensions can also be varied for particular coupler carriers.

The use of clips or brackets that are adapted to be mounted on the coupler carrier on the exterior of the center sill assembly provides an advantage in renewing the coupler carrier wear plates. Removal of brackets, even where welded, can be done with comparative ease with the use of a cutting torch and hand tools. In this manner, a coupler may be jacked, brackets or clips removed, and the coupler carrier wear plate slid outwardly in a matter of minutes with a minimum number of persons. The jacking of the coupler can be accomplished with comparative ease as no large, heavy components are actually removed from the railcar. The clip and bracket welds are neither complex nor structural and, accordingly, the same welding outfit used for cutting can essentially be used for rewelding after replacement after a new coupler carrier wear plate is slid in place.

Other forms of affixation may well be adaptable such as the use of bolts, studs, rivets, or adhesives, although the clips described herein are believed to provide maximum efficacy in the coupler carrier wear plate environment at this time.

Coupler carrier wear plates made in accordance with this invention can be formed from a variety of plastic molding techniques. Unlike, for example, prior art, coupler carrier wear plates having "T" shaped bearing webs, the wear plates of the invention can be used in the same railcars in the field, but may be produced by extrusion rather than molding.

As many and varied modifications of the subject matter of this invention will become apparent to those skilled in the art from the detailed description given hereinabove, it will be understood that the present invention is limited only as provided in the claims appended hereto.

In accordance with our invention, we claim:

1. A rail car coupler carrier wear plate for a rail car having a coupler and a coupler carrier comprising:

a first flange for bearing a rail car coupler and a second outer flange depending downwardly therefrom, whereby said first flange is readily insertable between the coupler and the coupler carrier;

said first flange and said second flange being formed to have a generally "L" shaped section said first flange being formed to have a plan form having a first parallel side, a second parallel side and two opposed converging sides;

said first parallel side being a side at which said second outer flange is formed;

said second parallel side being shorter than said first parallel side.

2. The coupler carrier wear plate of claim 1 and said coupler carrier wear plate being mounted to said coupler carrier with a bracket arrangement.

3. The coupler carrier wear plate of claim 2 and said bracket arrangement having a first bracket flange for mounting to the coupler carrier and a second bracket flange capturing said coupler carrier wear plate second flange between said second bracket flange and said coupler carrier.

4. The coupler carrier wear plate of claim 3 and said bracket arrangement further comprising a first bracket and a second bracket, formed and arranged as one of either (a) a transversely extending first bracket with said second bracket mounted vertically thereon or (b) a pair of transversely spaced brackets in which each of said first bracket and second bracket in said pair captures one corner of said first flange.

5. The coupler carrier wear plate of claim 3 and said bracket arrangement further comprising a first bracket and a second bracket, formed and arranged as a transversely extending first bracket with said second bracket mounted vertically thereon;

said first bracket being of right angle section and said second bracket being of right angle section.

6. The coupler carrier wear plate of claim 3 and said bracket arrangement further comprising a pair of transversely spaced first and second brackets each of said first and second brackets capturing one corner of said first flange, said first and second brackets being of general Z shaped section and being mirror images of one another.

7. The coupler carrier wear plate of claim 2 and means for mounting said coupler carrier wear plate to the coupler carrier by capturing said coupler carrier wear plate second flange.

8. The coupler carrier wear plate of claim 7 and said means for mounting further comprising a first bracket and a second bracket, formed and arranged as one of:

(a) a transversely extending first bracket with said second bracket mounted vertically thereon or (b) a pair of transversely spaced brackets in which each bracket in said pair captures one corner of said first flange.

9. The coupler carrier wear plate of claim 1, said coupler carrier wear plate being mounted to the coupler carrier with a bracket arrangement;

said bracket arrangement mounting said coupler carrier wear plate to the coupler carrier using a bracket mounted on said coupler carrier outboard said coupler carrier wear plate being captured between said bracket and coupler carrier and protecting said coupler carrier wear plate from damage in the case of a coupler override.

10. The coupler carrier wear plate of claim 9 and said bracket arrangement being formed of a high strength material directly bondable to said coupler carrier and said coupler carrier wear plate being formed of a high strength and durable plastic material formed to have lubricating properties when bearing the coupler.

11. A rail car coupler carrier wear plate for a rail car having a coupler and a coupler carrier comprising a first flange for bearing a rail car coupler and a second outer flange depending downwardly therefrom, whereby said first flange is readily insertable between the coupler and the coupler carrier, said first flange being formed to have trapezoidal plan form having a first parallel side, a second parallel side and two converging sides.

12. A rail car coupler carrier wear plate for a rail car having a coupler and a coupler carrier comprising a first flange for bearing a rail car coupler and a second outer flange depending downwardly therefrom, whereby said first flange is readily insertable between the coupler and the coupler carrier;

said first flange and said second flange being formed and arranged to have a generally "L" shaped section;

said first flange being formed to have a plan form having a first parallel side, a second parallel side and two opposed sides;

said first parallel side being a side at which said second outer flange is formed said first flange being formed to have said first parallel side being longer than said second parallel side and said two opposed sides converging inwardly from the mouth of the coupler carrier.

13. The coupler carrier wear plate of claim 12 and said first flange being formed to have a trapezoidal plan form having said second parallel side being shorter than said first parallel side.

14. The coupler carrier wear plate of claim 12 being mounted to said coupler carrier with a bracket arrangement, said bracket arrangement comprising:

a plurality of elongated angle section members;

said angle section members being bondable to one another;

said angle section members being bondable to said coupler carrier;

said angle section members capturing said second flange between one of said members and said coupler carrier.

15. The coupler carrier wear plate of claim 12 being mounted to said coupler carrier with a bracket arrangement, said bracket arrangement comprising:

a generally "Z" shaped clip member;

said clip member being bondable to said coupler carrier;

said clip member capturing said second flange between said member and said coupler carrier.

16. A rail car coupler carrier wear plate for a rail car having a coupler and a coupler carrier comprising a first flange for bearing a rail car coupler and a second outer flange depending downwardly therefrom, whereby said first flange is readily insertable between the coupler and the coupler carrier;

said first flange and said second flange being formed and arranged to have a generally "L" shaped section;

said first flange being formed to have a plan form having a first parallel side, a second parallel side and two opposed sides;

said first parallel side being a side at which said second outer flange is formed;

said coupler carrier being mounted to said coupler carrier with a bracket arrangement;

said bracket arrangement comprising one of the following combinations:

a plurality of elongated angle section members;

said angle section members being bondable to one another;

said angle section members being bondable to said coupler carrier;

said angle section members capturing said second flange between one of said members and said coupler carrier, or a generally "Z" shaped clip member;

said clip member being bondable to said coupler carrier;

said clip member capturing said second flange between said member and said coupler carrier.

* * * * *